US007546708B2

(12) United States Patent
Konstantin

(10) Patent No.: US 7,546,708 B2
(45) Date of Patent: Jun. 16, 2009

(54) LIGHT TRANSMISSION PANELS, RETAINING CLIP AND A COMBINATION THEREOF

(75) Inventor: Moshe Konstantin, Highland Park, IL (US)

(73) Assignee: Konvin Associates Limited Partnership, Lake Forest, IL (US)

( * ) Notice: Subject to any disclaimer, the term of this patent is extended or adjusted under 35 U.S.C. 154(b) by 472 days.

(21) Appl. No.: 10/960,156

(22) Filed: Oct. 7, 2004

(65) Prior Publication Data

US 2005/0120646 A1 Jun. 9, 2005

Related U.S. Application Data

(63) Continuation-in-part of application No. 10/607,748, filed on Jun. 27, 2003, now Pat. No. 7,441,379.

(51) Int. Cl.
*E04H 9/16* (2006.01)
*E04H 9/14* (2006.01)

(52) U.S. Cl. ..... 52/200; 52/469; 52/461; 52/460; 52/582.1; 52/459; 52/852

(58) Field of Classification Search ..... 52/200, 52/463, 464, 466, 582.1, 586.1, 469, 57, 52/465, 471, 470, 584.1, 582.2, 459, 460, 52/850, 851, 711, 703, 715; 403/331, 293, 403/286

See application file for complete search history.

(56) References Cited

U.S. PATENT DOCUMENTS 783,807 A * 2/1905 Tuteur ..... 403/232.1
1,220,219 A 3/1917 Goldman
3,473,276 A 10/1969 Back et al.
3,483,665 A * 12/1969 Miller ..... 52/461
3,975,880 A 8/1976 Fischer, Jr.
4,075,811 A * 2/1978 Keith ..... 52/395
4,117,638 A 10/1978 Kidd et al.
4,139,974 A * 2/1979 Fox ..... 52/404.2
4,271,651 A 6/1981 Sorrells, Jr.
4,389,823 A 6/1983 Player
4,402,168 A * 9/1983 Maier, Jr. ..... 52/478

(Continued)

FOREIGN PATENT DOCUMENTS

EP 490633 6/1992

(Continued)

*Primary Examiner*—Phi Dieu Tran A
(74) *Attorney, Agent, or Firm*—Fitch, Even, Tabin & Flannery

(57) ABSTRACT

A glazing panel system is provided using retention clips formed of folded sheet metal having a top flange for engaging and retaining a pair of glazing panel ends against uplift forces generated by high velocity winds flowing across the glazing panels. The preferred one piece retention clip has a two ply central web which is formed on the retention clip to be positioned at a seam between adjacent glazing panels and these plies may be welded together to increase the strength of the central web. This top flange is strengthened to resist bending of its right or left flange section by raised portions extending normal to the fold lines that join the respective top flange sections to the top of the central web. The preferred retention clip also is formed with spot welds to join the two plies of the central web.

11 Claims, 6 Drawing Sheets

U.S. PATENT DOCUMENTS

| | | | | | |
|---|---|---|---|---|---|
| 4,435,937 | A | * | 3/1984 | Stone | 52/520 |
| 4,649,684 | A | * | 3/1987 | Petree et al. | 52/395 |
| 4,920,725 | A | * | 5/1990 | Gore | 52/702 |
| 4,998,395 | A | | 3/1991 | Bezner | |
| 5,363,624 | A | * | 11/1994 | Cotter | 52/547 |
| 5,584,155 | A | | 12/1996 | Watanabe | |
| 6,151,845 | A | | 11/2000 | Lancaster | |
| 6,164,024 | A | | 12/2000 | Konstantin | |
| 6,272,812 | B1 | | 8/2001 | Richardson | |
| 6,487,821 | B1 | | 12/2002 | Thomsen et al. | |
| 6,591,557 | B1 | | 7/2003 | Thomsen et al. | |
| 6,637,170 | B2 | * | 10/2003 | Ito | 52/506.06 |
| 6,807,779 | B1 | | 10/2004 | Hocker et al. | |
| 6,845,592 | B2 | | 1/2005 | Voegele | |
| 6,988,344 | B1 | | 1/2006 | Krueger | |
| 7,313,893 | B2 | * | 1/2008 | Voegele, Jr. | 52/461 |
| 2001/0029708 | A1 | | 10/2001 | Richardson | |

FOREIGN PATENT DOCUMENTS

| | | |
|---|---|---|
| GB | 2204627 | 11/1988 |
| GB | 2214961 | 9/1989 |

* cited by examiner

LIGHT TRANSMISSION PANELS, RETAINING CLIP AND A COMBINATION THEREOF

CROSS-REFERENCE TO RELATED APPLICATION

This application is a continuation-in-part of U.S. patent application Ser. No. 10/607,748 filed on Jun. 27, 2003 now U.S. Pat. No. 7,441,379.

FIELD OF THE INVENTION

This invention relates to a high performance architectural glazing panel system, a folded sheet metal retention clip and a method of making a folded sheet metal retention clip for retaining the glazing panels against separation particularly due to uplift loads from high velocity winds flowing over the glazing panels.

BACKGROUND OF THE INVENTION

Rather then reproducing in this application all of the above-identified parent application, only selected portions thereof are reproduced herein in order to focus on the improved retention clip and gazing panel system disclosed in detail herein. The above-identified application is hereby incorporated by reference as if fully reproduced herein.

As disclosed in U.S. Pat. Nos. 4,573,300 and 6,164,024, modular glazing panels are used with a framing grid of purlins and rafters to form a wall, an overhead or roofing structure such as for skylights, covered walkways, pool enclosures, building atriums, greenhouses, etc. Glazing panels generally have light transmission properties to allow light to pass through the structure to illuminate interior regions covered by the glazing panels. The glazing panels disclosed in the above-identified patents as well as those made by other manufacturers are provided with upstanding seam flanges which extend along the side edges at the ends of the panels for being connected to one another with connectors. As disclosed in U.S. Pat. No. 4,573,300, the upstanding seam flanges were provided with projecting saw teeth and batten type joining connectors having internal saw teeth which were pushed down over the saw teeth on the seam flanges to snap fit the saw teeth together to join the adjacent panels by means of the batten only. U.S. Pat. No. 6,164,024 discloses the use of improved joining or retention clips made of metal which are used to join adjacent seam flanges together as well as cooperating with a batten which covers the seam flanges and clips. The retention clips have top flanges that provided the clip with improved holding power to hold the panels against becoming loose and sliding out from the glazing panel system during high wind loading of the glazing panel system. More specifically, high winds flowing across very large surfaces exert negative uplift forces on the panels which tend to separate the panels from one another and the retention clips as well as the battens are required to retain the glazing panel structure intact despite such forces. This vacuum or negative pressure caused by high winds flowing over the glazing panels with a pressurized interior of the building can cause the glazing panels to be pulled off unless the clips and panels are sufficiently strong to resist the forces being generated.

The glazing panels tend to bow upwardly under negative wind loads due to high velocity wind flow across the outer external major surfaces of the glazing panels. A positive air pressure on the interior surface also may contribute to this bowing of the glazing panels. Testing shows that as the adjacent glazing panels bow, the lower interior ends of the glazing panels separate and form a larger gap therebetween. In the glazing panel systems without a retention clip, the enlarging space between these lower interior ends of the glazing panels tends to break the engagement of the toothed surfaces on the upstanding seam flanges and depending legs of the inverted channel seam covering connector which covers the seam between adjacent panels. These uplift loads then tend to pop the U-shaped connector up as the teeth of the upstanding seam flanges separate from the teeth on the legs of the inverted channel connector.

When a retention clip is present as well as the inverted channel connector, as disclosed in U.S. Pat. No. 6,164,024, the top ends of the seam flanges pivot or hinge under the clip top flange as the panels increase in their amount of bowing and the gap at the lower ends of the panels increases due to increase bowing of the panels. The angle defined between adjacent upstanding seam flanges hinged at their upper ends increases with increased bowing of panels and also the gap increases between lower interior ends of the glazing panels. At sufficiently high uplift loads, e.g., exceeding that for which the glazing panel system is rated, the outer connector may flex outwardly and then separate its teeth from the teeth on the upstanding seam flanges resulting in the seam covering connectors being disconnected from the seam flanges and the upper ends of the glazing panels sliding outwardly from the top flanges of the retention clips. The forces being exerted by the glazing panels on the top flange of the retention clip tend to bend the top flange and to deform the retention clip to release its retention of the glazing panel. Thus, at loads greater than that for which the glazing panel system is rated, the glazing panels separate and may be lifted from the purlins and rafters resulting in a failure of the glazing panel retention systems.

Various codes have been adapted, particularly in hurricane designated areas, to subject windows, skylights and other glazing panel systems to uplift loads and negative forces which might be encountered during a hurricane or the like. One such standard is South Florida Building Code (SFBC). United Laboratories Standard "UAL 580" sets forth three different standards or ratings for glazing panel systems of 90, 60 and 30. To meet the UAL 580 standard or rating 90 the glazing panels are subjected and must resist an uplift wind load of 105 pounds per square foot (psf). For the UAL 580 standard 60, the glazing panel system must resist an uplift load of 75 psf. The UAL 580 standard 30 tests the glazing panel systems with an uplift load of 45 psf. Manifestly the present invention is not limited to any particular standard but these standards are set forth only by way of example; other standards that are currently use such as those set forth by the American Society of Civil Engineers, ASCE-7, ASTME 1996 and IBC. Another standard is ASTME 1886-97 "Standard Test Method for Performance of Exterior Windows, Curtain Walls Impacted by Missiles and Exposed to Cyclic Pressure Differentials."

In the aforesaid, copending patent application, a number of retention clips are disclosed and made in different manners such as extruded metal retention clips, clips made of several portions joined together, or bent, folded metal clips. Also, this copending application discloses glazing panels of a unique construction to be retained by having the retention clips top flange engaging in pockets below the top of the upstanding seam flanges to lower the hinge point, described above. The present invention is directed to making a retention clip that is not only strong so that it can meet the higher standards described above, but which is also inexpensively manufactured from sheet metal.

More specifically, there is a need for an inexpensive clip that is useable to retain the glazing panels that is strong and. preferably sufficiently small in size, that it will be covered by the purlin which is supporting the glazing panels from being viewed by a person located beneath the glazing panel system. Preferably, this inexpensive clip is sufficiently strong that it can be effective against uplift forces of 120 psf, i.e. pounds per square feet, created by winds flowing across the top surfaces of the glazing panels. In addition to being strong and inexpensive, it is preferred that the clips be corrosion resistant particularly to galvanic corrosion where the underlying purlin, which is supporting the clips, is made of steel.

SUMMARY OF THE INVENTION

In accordance with the embodiments of the invention, there is provided a new and improved, as contrasted with the prior art, retention clip and/or glazing panel system using the retention clip. The retention clip is made strong and inexpensively from sheet metal. In the preferred embodiment, a single piece of sheet metal is folded to form a two ply top flange, and an integral two ply central web for the retention clip. Further, strength is provided by welding together, at least the central web plies. The top flange is strengthened by forming upstanding areas therein, preferably these areas being in the shape of elongated, upstanding ribs extending over the central, two ply central web. In a further embodiment, the retention clip is formed in two separate halves.

In accordance with an important aspect, the folded sheet metal retention clip is formed inexpensively by a method comprising bending a central portion of the sheet metal piece to form a two ply top flange for the retention clip, placing together adjacent portions of the sheet metal that are integral with and adjacent to the top flange to form a two ply central web that will comprise the upstanding central web for the retention clip, bending at least one opposite end of the sheet metal piece to project outwardly from the central web to form a base flange, and joining together the two plies of the central web as by welding to provide a stronger central web. In the preferred method, the metal sheet is bent in a progressive die located within a stamping press. Additional strength may be imparted to the top flange by stamping out raised areas in the sheet metal. The illustrated, raised areas are in the form of elongated ribs extending across the central web to strengthen the top flange against improved bending by upwardly directed bending forces being exerted thereon by the glazing panels in high wind situations.

DETAILED DESCRIPTION OF THE PREFERRED EMBODIMENT

Figure 5:
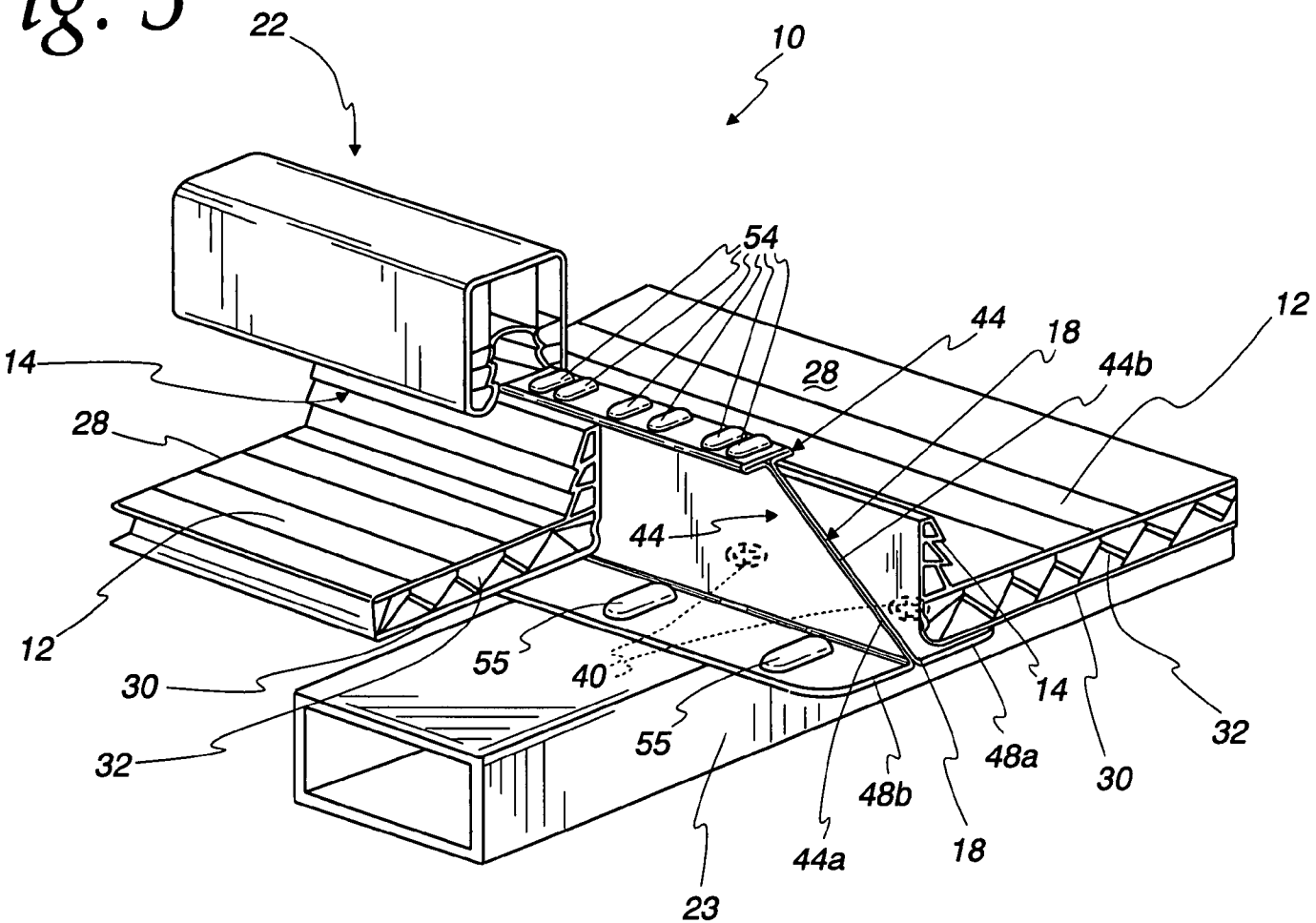
FIG. 5 is a cross-sectional view of a glazing panel system in accordance with another embodiment having a top flange of the retention clip at the top sheet surface of the glazing panel.

As is shown in the drawings for purposes of illustration, a glazing panel system 10 is shown in FIG. 5 as including modular extruded, glazing panels 12 that have a generally rectangular shape with upstanding projecting seam flanges 14 extending on either side of the glazing panels along their length. The preferred panel members 12 are preferably extruded and are formed with upper and lower sheets or surfaces 28 and 30 which are connected by an internal supporting structure which is shown herein in the form of ribs 32 but may have other shapes as disclosed in the aforementioned patents. Alternatively, solid plastic panel members having a solid plastic cross-section without any interior spaces or ribs may be used. The ribs 32 extend transverse to the flat sheets 28 and 30. The glazing panels are made of materials that allow light transmission therethrough such as transparent or translucent plastics, although the plastics could be opaque colored or otherwise tinted. The upstanding seam flanges on the panels extend substantially perpendicular to the upper and lower sheets 28 and 30 along the ends of the panels. Often the panels 12 are approximately 2 feet to 4 feet in width and can have a length of up to 60 feet. It will be recognized that other sizes and forms of panels with associated seam flanges can be used and fall within the purview of the present invention. The panels are made with upstanding seam flanges positioned adjacent one another in a parallel relationship forming a seam between adjacent panels which is covered and made waterproof by a connecting batten or outer connector 22 which is preferably snap fitted over the seam flanges to cover the seams formed therebetween.

A number of prior art retention clips have been used to retain the glazing panels connected to the supporting purlins and rafters so that the glazing panels maintain the roofs integrity despite the application of high velocity winds across the surface of the roof. With high velocity winds and particularly with hurricane-type high velocity winds, the large surface area of the top surface of the glazing panels results in large uplift loads being applied to the glazing panels that bow and tend to bend the small bent flanges on the retaining clips as illustrated in FIG. 13 in U.S. Pat. No. 6,164,024. In that patent improved stronger retention clips were formed and disclosed, see for example, FIG. 3 of the U.S. Pat. No. 6,164,024 wherein a top flange 46 on the retention clip overlies the tops of the seam flanges and a retention clip has a base flange 48 which is secured by a fastener 52 to a purlin 23.

Figure 8:
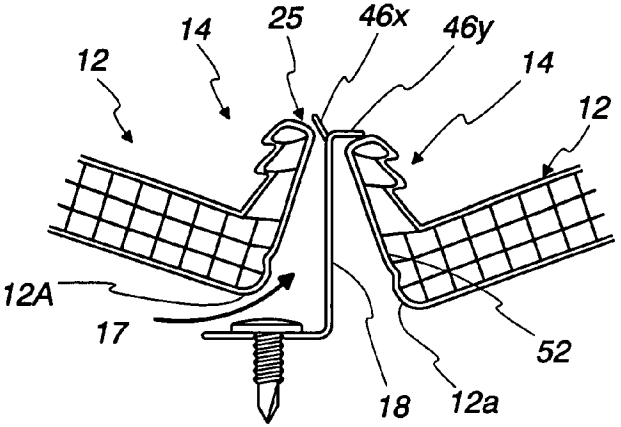
Fig. 8 (prior art)
FIG. 8 is a cross-sectional view of a sheet metal prior art clip with a left portion of the top flange of the retention clip being bent upwardly by the seam flange of the glazing panel.
Figure 9:
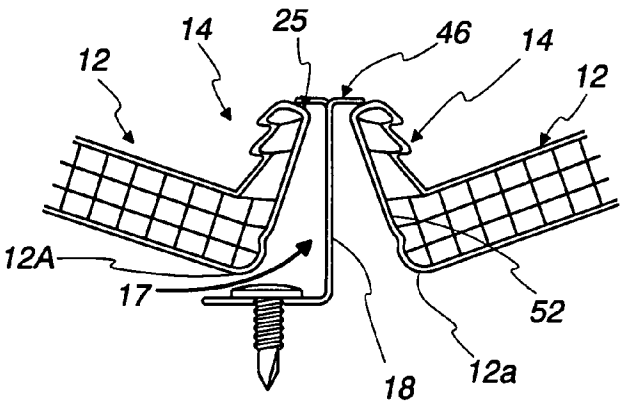
Fig. 9 (prior art)
FIG. 9 shows the prior art retention clip of FIGS. 8 and 9.

In the aforementioned patents, U.S. Pat. Nos. 4,573,300 and 6,164,024, the application of the restraining force, which is holding the glazing panel down, is at a high location at the top of the upstanding seam flange. During sufficiently high velocity winds, e.g., hurricane force winds, the glazing panel which is flexible and made of plastic bows in the center between the opposite seam flanges and the seam flanges tend to move outwardly with a force being exerted at an acute angle between the vertical and horizontal which is pulling the seam flanges outwardly from the retention clip causing the pivoting at the hinge point and a large gap between adjacent lower corners of adjacent glazing panels. Also, at this time, the integrity of the clips and the inverted U-connectors may be adversely affected, e.g., a left hand portion 46*x* of the prior retention clip shown in FIG. 8 may be bent upwardly from its horizontal position (FIG. 9) to be inclined, as shown in FIG. 8 which allows the left clamping panel to be extracted. The retention clip may be otherwise deformed by the upward forces being applied thereto by the glazing panels.

Figures 6, 7:
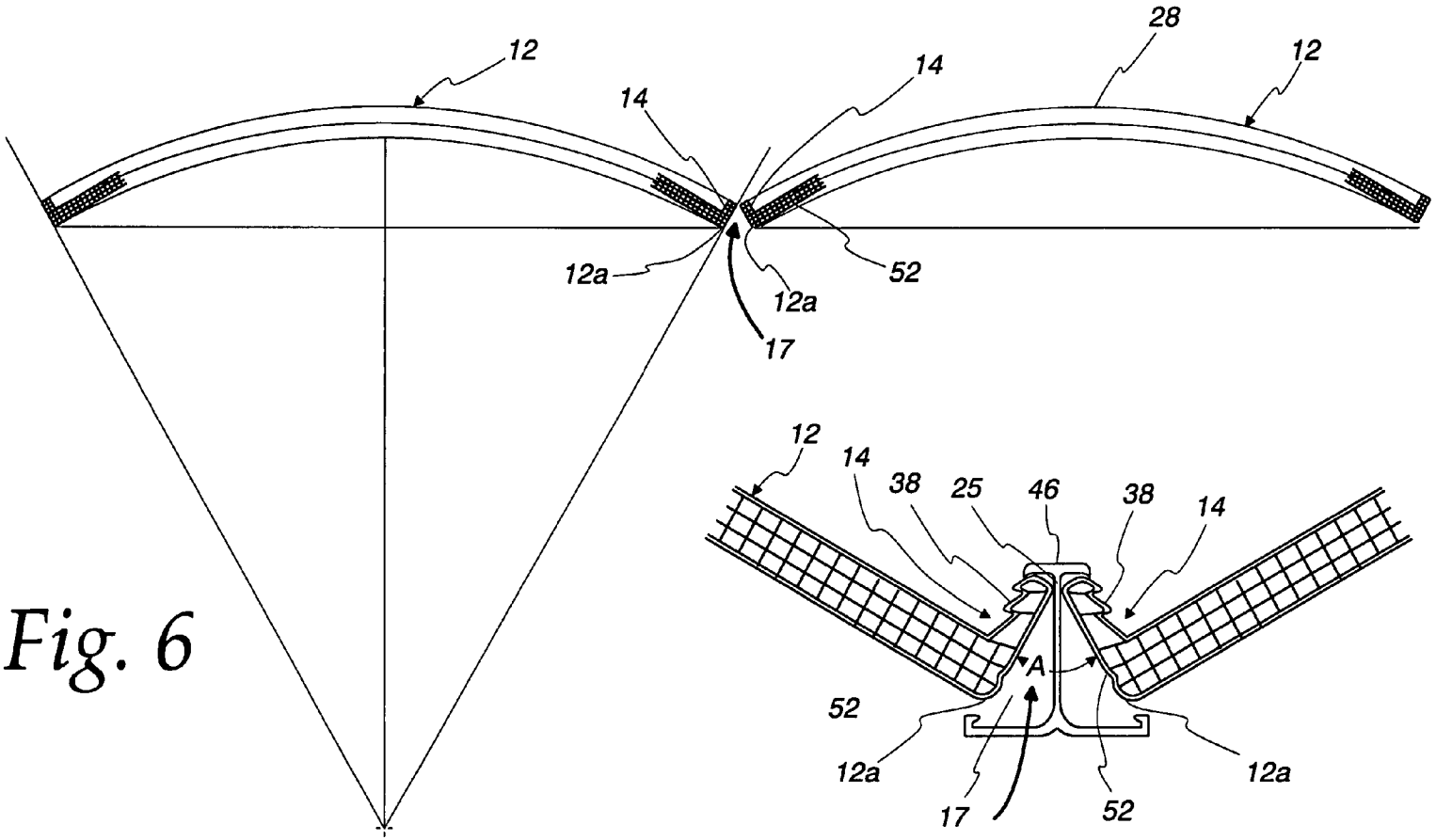
Fig. 7 (prior art)
FIG. 6 is a diagrammatic view of glazing panels bowed by negative uplift loads creating a gap between the lower corners thereof.
FIG. 7 is an enlarged, fragmentary cross-sectional view if the prior art construction in which adjacent lower corners of the seam flanges are pivoting about their upper ends at the underside of the top flange and creating the gap.
Figure 10:
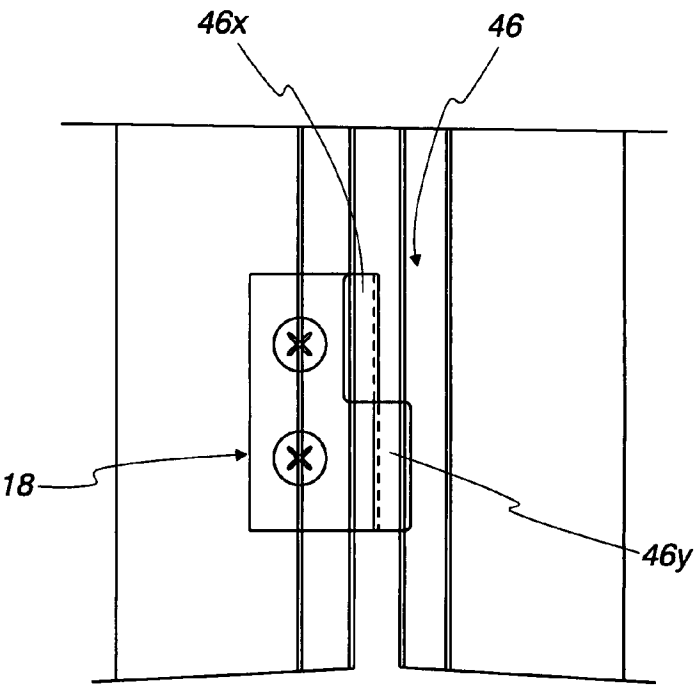
Fig. 10 (prior art)
FIG. 10 is a plan view of the prior art retention clip which is shown bent in FIG. 8.

As seen in FIGS. 6 and 7, the glazing panels tend to bow upwardly under negative wind loads due to high velocity wind flow across the outer external major surfaces 28 of the glazing panels. A positive air pressure on the interior surface also may contribute to this bowing of the glazing panels. As the adjacent glazing panels bow, the lower interior ends 12*a* of the glazing panels 12 separate and form a larger gap 17 therebetween. In the glazing panel systems without a retention clip, as in U.S. Pat. No. 4,573,300, the enlarging gap 17 between these lower interior ends 12*a* of the glazing panels tends to break the engagement of toothed surfaces 38, 40 on the upstanding seam flanges and depending legs of the inverted channel seam covering connector which covers the seam between adjacent panels. These uplift loads then tend to pop this external U-shaped connector up as the teeth of the upstanding seam flanges separate from the teeth on the legs of the inverted channel connector.

When a retention clip is present as well as the inverted channel connector 22, the top ends 15 of the seam flanges 14 pivot or hinge at a hinge point 25 under the clip top flange 46 as the panels increase in their amount of bowing and the gap 17 between the lower ends 12*a* of the panels increases due to increase bowing of the panels. The angle A (FIG. 7) defined between adjacent upstanding seam flanges 14 hinged at their upper ends at hinge point 25 increases with increased bowing of panels and also the gap 17 increases between lower interior ends of the glazing panels. At sufficiently high uplift loads, e.g., exceeding that for which the glazing panel system is rated, the outer batten connector separates its teeth 38 from the teeth on the upstanding seam flanges resulting in the seam covering, batten connector being disconnected from the seam flanges and the upper ends of the glazing panels sliding outwardly from the top flanges of the retention clips. Thus, at loads greater than that for which the glazing panel system is rated, the glazing panels separate and may be lifted from the purlins 23 and rafters resulting in a failure of the glazing panel retention systems.

In accordance with the embodiment of FIGS. 1-5, a new and improved clip 18 is provided that is made of folded metal sheet such as by a stamping process for high production efficiency and low cost with folded portions welded together to increase the strength of the clip to thereby resist the uplift loads encountered and preferably with projecting portions formed in the metal sheet to increase the rigidity of the top flanges 46 that overlie the tops of the seam flanges 14 of the glazing panels 12. Increased strength is achieved by welding together the pair of upstanding central web portions 44*a* and 44*b* as by spots welds 49 (FIG. 3) to have them combine their strength and further rigidity is obtained from the spot welds 49 to resist upload forces. Further, strength to resist a bending of either of the top flanges 46 is achieved by forming them with two plies or plates and by having the projecting portions being in the form of stamped ribs 54 in the top flange extending across the central web and at right angles to a fold line between the top flange and the central web.

The metal clip 18 shown in FIGS. 1-5 is also made smaller and stronger by forming it of stainless steel rather then the usual steel. Stainless steel is also considerably stronger than aluminum sheet metal or extruded aluminum. If steel or aluminum were used to replace the preferred stainless material, the clip would have to be made larger to provide the same strength as a thin cross section, folded stainless steel clip, which is illustrated in FIGS. 1-5.

Thus, the clip 18, may be relatively small with added strength being provided thereto from the spot welds 49, the ribs 54 in the top flange 46, and the use of stainless steel as the preferred metal. The small size and the greater strength of the clip allows it to withstand uploads of at 120 psf, i.e. pounds per square foot applied by uplift loads as from high velocity winds flowing across the exposed outer surfaces of the glazing panels 12. The central web is very thin e.g. 0.050 inch thick so that upstanding, facing sides of upstanding seam flange may be placed closely adjacent to one another to maintain a relatively narrow width for the seam between glazing panels, and yet provide a strong joinder of pair of adjacent glazing panels to withstand large uplift forces.

The esthetic look of the seam and concealment of the retention clip is also enhanced by adding ribs 55 (FIGS. 1 and 2) to a bottom flange portion 48*b* of the bottom flange 48. The ribs 55 project upwardly to a height approximately equal to the height of heads 40*a* of fasteners 40 such as self tapping screws (FIG. 1) that are threaded into the underlying purlin. Thus, the left and right seam flanges are raised an equal height by the respective fastener heads and ribs 55 from the main bottom flanges bodies extending to left and right of the upstanding central web 44 of the clips 18. Further, the clip 18 is also, preferably concealed, at least substantially, by making its bottom flange size to about match the size of the underlying purlin or support that is often a nominal 1.50 inches in width. Because the upper flange is disposed above the glazing panels and not viewable from below the glazing panels, the top flange 46 may be longer and extend beyond the width of the purlins, e.g. to about 2.00 in width in the illustrated embodiment.

Figure 1:
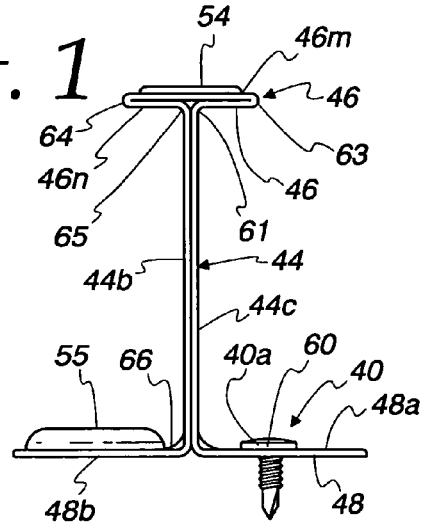
FIG. 1 is a elevational view of a retention clip in accordance with an embodiment of the invention.
Figure 2:
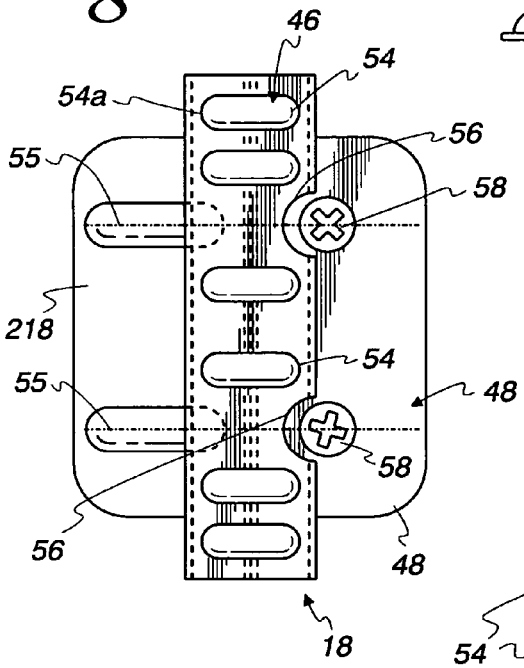
FIG. 2 is a plan view of the retention clip of FIG. 1.
Figure 3:
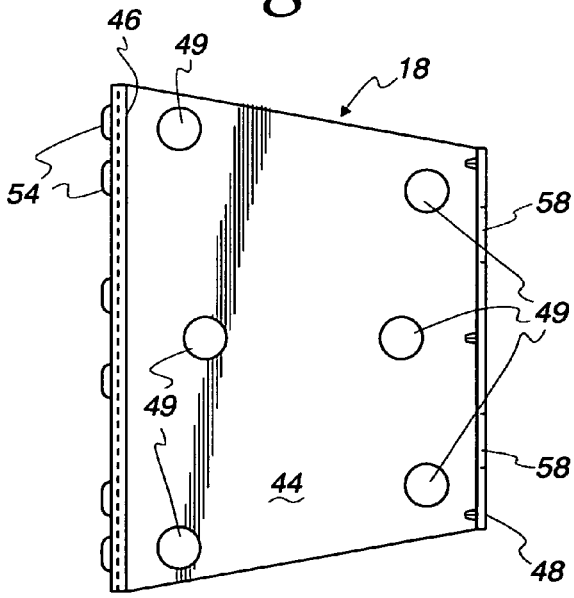
FIG. 3 is a side elevational view of the retention clip of FIG. 1.
Figure 4:
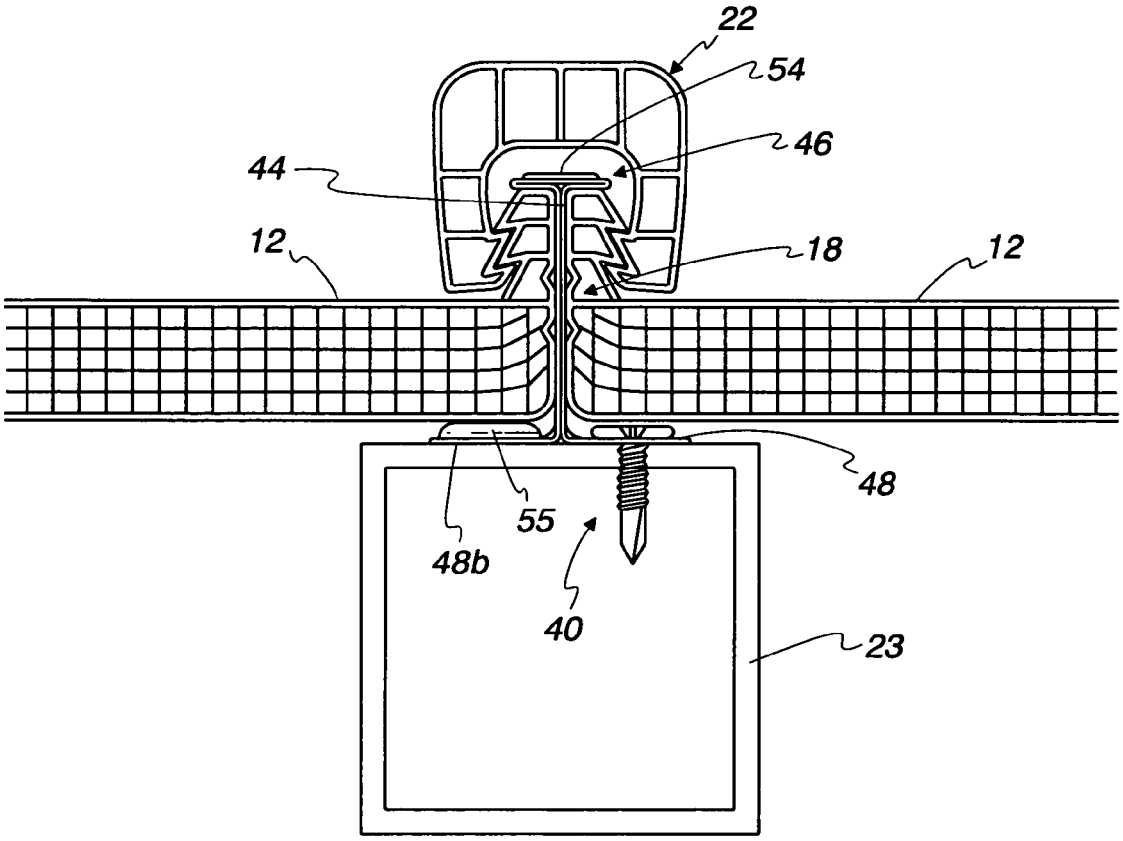
FIG. 4 is a cross-sectional view of the clip of FIG. 1 installed in position and retaining glazing panels.

Turning now in greater detail to the retention clip 18 illustrated in FIGS. 1-3, it is formed from a thin sheet of stainless steel, e.g. 0.025 inch thick of 301/302 ½ hard that is bent in a progressive die in a stamping press. The strengthening ribs 54 preferably extend across the central web and into the respective right and left halves of the top flange to reinforce each of them against bending upwardly about their respective fold lines 61 and 65 with the top of the central web. The strengthening ribs are at right angles to these respective fold lines making it more difficult to bend the respective top flange halves because it is necessary to overcome the stiffness and rigidity of the ribs before the respective top flange halves can bend about their respective bend lines 61 and 65. Herein, six ribs are provided to stiffen the left and right flange halves against being bent upwardly to release the respectively engaged left or right seam flange 14 of the respective left and right glazing panels 12.

In the illustrated embodiment, the stamping press and die also form the ribs 54 in the top flange 46 with the illustrated ribs having a height of about 0.03 inch and a length to extend substantially across the width of the top flange that is about 0.49 inch in width. The ribs are formed in the top flange section 46*m* and not in the lower top flange sections 46*n*. In the illustrated top flange, there are six ribs with two outer pairs of ribs and a pair of inner ribs making a total of six ribs in about two inch extent of the top flange 46. The illustrated ribs have rounded corner 54*a*. The size, number and shape of the ribs may vary substantially from the described herein and still function to stiffen the top flange so as not to be bent as would allow the escape of the seam flange 14, as illustrated in FIG.

8 and described above. Likewise, the size dimensions for the retention clip provided herein are only by way of example and not by way of limitation, as these dimensions may be varied. For example, the upstruck reinforcing portions 54 may have shapes other than the illustrated, long narrow ribs and could be made in the lower flange section of the top flange. The metal blank is formed with these struck reinforcing portions by portions of the progressive die.

In order for the top flange 46 not to interfere with a driver for the fastener 40, which is typically a self tapping screw, the top flange 46 may be provided with two, substantially, semi-circular grooves 56 (FIG. 2) in the outer longitudinal edge of the top flange. These semicircular grooves are aligned with the fastener receiving holes 58 formed in the base flange 48. These semi-circular grooves are disposed between the strengthening ribs 54 formed in the top flange. Herein, two holes 58 are formed in the right section 48*a* of the base flange 48 and the two ribs 55 are formed in the left section 48*b* of the base flange. In the one piece folded construction of retention clip illustrated in FIGS. 1-3, the ribs 55 are aligned opposite the fasteners 40 positioned in the holes 58 on the other side of the upstanding central web 44 thereby spacing the bottom sheet surface 30 of the left glazing panel upwardly by the same distance as the height of the fastener head 40*a*, e.g. about 0.083 inch. Herein, these ribs 55 are about 0.19 inch in width and about 0.50 in length. The ribs 54 also make the lower flange 48 more stiff. The left flange section 48*b* will be formed at one end of the stainless steel sheet and the right section 48*a* will be formed at the opposite end of the sheet, in this illustrated embodiment. Rather than having the right and left base flange sections 48*a* and 48*b*, the left base section can be eliminated in some instances leaving only a single base section for the base flange which is fastened to the purlin. The semi-circular grooves 56, holes 58, ribs 54, and ribs 55 are formed in the sheet metal blank which is being folded in the progressive die in the stamping press. It is possible that the retention clip can be made in more than one piece. Thus, the metal body of the retention clip may be made of one-piece, as in the illustrated embodiment of FIGS. 2-5 or the metal body may be formed of several pieces. These pieces could be joined together by welds such as the illustrated welds 49.

In the folded clip 18 illustrated herein, the metal sheet is formed with a first bend or fold line 60 between the right base flange section 48*a* and a right upstanding section 44*a* of the upstanding central web 44. The bend 60 joins these respective section with the base section being horizontal and the upstanding central web section being vertical. A second bend or fold line 61 at the top of the upstanding central web section 44*a* joins it to a horizontal, lower web section 46*a* of the lower panel 46*m* of the top flange 46. This lower web section 46*a* projects horizontally to a fold or bend line 63 where the metal sheet is folded back on itself through about 180° to form the top panel 46*m* of the top flange which extends horizontally across the top of retention clip. At the opposite edge of top flange the sheet is bent at a bend or fold line 64 back and beneath for about 180° to form the left section of the lower panel 46*n*. These end sections 46*m* and 46*n* are in surface-to-surface engagement with one another as are the upstanding panels or sections 44*a* and 44*b* defining the upstanding central web 44. The left portion of the lower panel 46*n* is joined at fold line 65 to the upstanding left section 44*b* of the upstanding web. At the lower end of the latter is a bend or fold line 66 at which is joined the left lower flange section 48*b* of base flange 48. Thus, it will be seen that the single sheet of metal defining the body of the retention clip is bent at the respective bends 60-66 to form the clip with a central web having two central web panels 44*a* and 44*b* which are later joined together by the welds 49 to provide a double thickness for the upstanding central web and with the welds 49 adding further rigidity and strength thereto. The top flange 46 also is formed with two panels or sections 46*m* and 46*n* to provide a double metal thickness for the top flange and with the ribs 54 adding additional rigidity to the top flange.

The illustrated retention clip 18 is trapezoidal in shape (FIG. 3) with a smaller width base flange 48 and larger width top flange 46. Hence, the base flange is made with a width to be equal to or slightly less in width than the underlying purlin width so as to be concealed by the purlin when a person below the glazing panels looks upwardly to see the glazing panels and purlins. In this illustrated embodiment, the base flange is 1.5 inch which is the nominal width of a typical purlin and the top flange 46 is 2.0 inch in width. Because the top flange is usually located on top of the upstanding seam flanges 14 of the glazing panels and is usually covered by the external connector 22, the length of the top flange is not usually viewed. Hence, it can be made wider to increase the overall size and strength of the clip and provided a larger area of contact with the top of the seams flanges that are applying uplift heads to the top flange.

Figure 11:
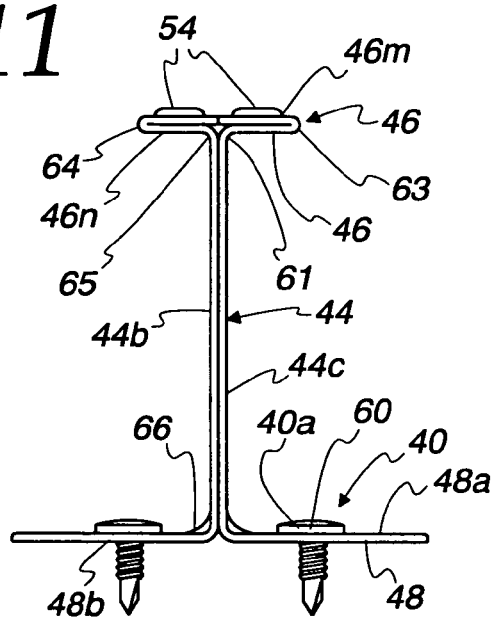
FIG. 11 is an elevational view of a retention clip formed with a separate left half and a right half in accordance with another embodiment of the invention.
Figure 12:
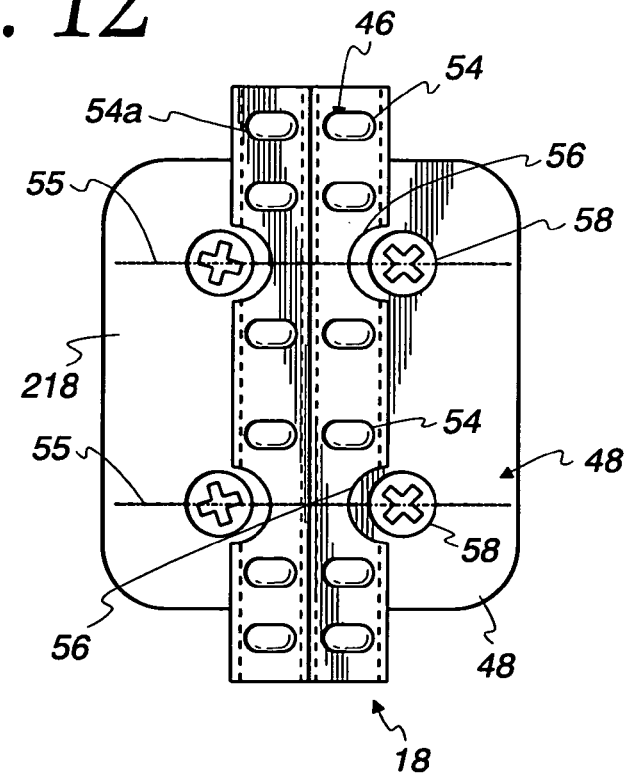
FIG. 12 is a plan view of the retention clip of FIG. 11.

In accordance with another embodiment, a retention clip is formed with two separate, discrete halves 18*a* and 18*b* (FIGS. 11 and 12) with each half having a top flange 46*a*, a central web 44*a*, and a bottom flange 48*x*. The central webs 44*a* in this instance are not attached to one another although they could be attached to each other such as by welding them as shown in FIG. 3. Each of the bottom flanges is formed with apertures 58*a* that allows securing of the flange by fasteners 60 to a supporting purlin or the like. The respective halves are preferably mirror images of each other with the top flange and bottom flange of the half 18*a* extending to the right, as seen in FIG. 11 and the top flange and bottom flange of the half 18*b* extending to the left as seen in FIG. 11. Herein, the top flange is preferably formed with a top ply or panel 48*m* and a bottom ply or panel 46*n* to provide extra strength to the top flange to resist bending. The respective top flange panels are integrally joined at fold line 63. Each half is made in one piece from a piece of folded sheet metal such as stainless steel. To strengthen the respective top flanges upraised portions 54 preferably in the form of ribs 54 may be formed in the top flange.

The size and shape of the two halves 18*a*, 18*b* are preferably made to be similar to that described above for the first embodiment shown in FIGS. 1-10 and hence will not be repeated.

From the foregoing, it will be seen that there has been provided a new and improved retention clip, glazing panel assembly having the retention clip, and a method of making the retention clip. The illustrations and descriptions of the clip shown in the drawings are of an illustrated embodiment and other embodiments may be made and still fall within the purview of the invention set forth in the claims.

What is claimed is:

1. A glazing panel system providing light transmission therethrough comprising:

a first glazing panel of plastic;

an upstanding seam flange on an end of the glazing panel and being joined at its lower end to the first glazing panel;

a first end on the first glazing panel;

a second glazing panel of plastic;

a first end on the second glazing panel;

an upstanding seam flange joined at its lower end to the first end of the second glazing panel;

a retention clip being disposed between adjacent first ends of the first and second glazing panels and being adjacent their respective upstanding seam flanges;

a base flange on the retention clip for connection to a lower support and having a first base flange section and a second base flange section;

a pair of face-to-face upstanding web sections on the retention clip disposed between the adjacent seam flanges, each upstanding web section joined at its lower end to a respective base flange section;

a welded portion joining the face-to-face-upstanding web sections together to form an upstanding central web for the retention clip;

a top flange having a top part joined to and substantially parallel to a first bottom part and to a second bottom part, each bottom part joined to an upstanding web section and the top part covering a space defined by the upstanding web sections, the top flange projecting laterally and the bottom parts engaging the seam flanges to hold the same against uplift forces; and a plurality of ribs formed on the top part of the top flange to stiffen the same to resist bending by the upstanding seam flanges experiencing the uplift forces;

wherein the ribs extend across the top part of the top flange and are oriented in a generally normal direction to bend lines joining the top flange to the upstanding, central web to stiffen the top flange and resist uplift of the top flange.

2. A glazing panel system in accordance with claim 1 wherein the retention clip comprises a folded, one piece sheet metal body having the top flange, the base flange and the upstanding web.

3. A glazing panel system in accordance with claim 2 wherein the retention clip is made of stainless steel.

4. A glazing panel system in accordance with claim 1 wherein the plurality of ribs are ribs stamped in the top part of the top flange.

5. A glazing panel system in accordance with claim 1 wherein the base flange has upstanding portions formed therein to strengthen the base flange.

6. A glazing panel system in accordance with claim 5 wherein the first base flange section extends outwardly from a lower end of the upstanding central web on one side thereof and the second base flange section extends outwardly from the lower end of the upstanding central web on the other side thereof;

the upstanding portions comprising elongated ribs being formed on the first base flange section and projecting upwardly therefrom for a height substantially equal to the height of heads of fasteners for securing the second base flange section to the lower support.

7. A glazing panel system in accordance with claim 1 wherein the top flange has one or more cut-out portions in the top flange, each cut-out portion aligned with a fastener receiving hole formed in the base flange.

8. A glazing panel system in accordance with claim 7 wherein each cut-out portion corresponds to a fastener in the base flange, the one or more cut-out portions reducing the interference between the top flange and a driver for the fasteners.

9. A glazing panel system in accordance with claim 8 wherein the one or more cut-out portions are substantially semi-circular grooves.

10. A glazing panel system in accordance with claim 1 further comprising gussets formed at the juncture of the base flange and the upstanding central web.

11. A glazing panel system in accordance with claim 1 wherein the welded portion comprising a plurality of spaced spot welds joining the upstanding web sections at spaced locations on the central upstanding web.

* * * * *